US006014966A

United States Patent [19]

Stevenson

[11] Patent Number: 6,014,966

[45] Date of Patent: Jan. 18, 2000

[54] HEAT TRANSFER UNIT FOR A FURNACE EXHAUST VENT

[76] Inventor: James R. Stevenson, P.O. Box 1617, Mansfield, La. 71052

[21] Appl. No.: 08/940,645

[22] Filed: Sep. 30, 1997

[51] Int. Cl.[7] ..... F24B 7/04

[52] U.S. Cl. ..... 126/110 R; 126/99 R; 237/55; 165/102; 165/156; 165/901

[58] Field of Search ..... 126/99 R, 117, 126/110 R, 110 D, 80; 165/102, 901, 156; 237/55; 122/20 B

[56] References Cited

U.S. PATENT DOCUMENTS

| | | | |
|---|---|---|---|
| 65,554 | 6/1867 | Ernst | 165/102 |
| 89,701 | 5/1869 | Sweet | 165/102 |
| 211,332 | 1/1879 | Kelley . | |
| D. 330,076 | 10/1992 | Evens . | |
| 330,633 | 11/1885 | Springer | 165/102 |
| 649,251 | 5/1900 | Maude . | |
| 676,180 | 6/1901 | Elmendorf . | |
| 766,190 | 8/1904 | Loehr . | |
| 1,025,736 | 5/1912 | Brewster . | |
| 2,439,109 | 4/1948 | Stout . | |
| 3,934,798 | 1/1976 | Goldsmith . | |
| 4,044,950 | 8/1977 | Engeleing et al. | 237/55 |
| 4,117,883 | 10/1978 | Feldmann . | |
| 4,147,303 | 4/1979 | Talucci | 126/99 D |
| 4,194,558 | 3/1980 | Gossmann . | |
| 4,241,874 | 12/1980 | Schossow . | |
| 4,503,902 | 3/1985 | Zolik . | |
| 5,311,930 | 5/1994 | Bruenn . | |

*Primary Examiner*—Carl D. Price

[57] ABSTRACT

A heat exchange device for harnessing heat from an exhaust vent is provided including a furnace having a main inlet for receiving cooled air suctioned from a living area, a heating mechanism for heating the cooled air suctioned from the living area, a main outlet for delivering air to the living area which is heated by the heating mechanism, and an exhaust vent coupled to the furnace for expelling air associated with the generation of heat by the heat mechanism with such expelled air not being fit for channeling to the living air via the outlet. Next provided is a housing which divides the exhaust vent into a lower portion and an upper portion. The housing has an auxiliary inlet in communication with the living area for receiving the cooled air therefrom and an auxiliary outlet in communication with the living area for expelling air thereto. Lastly, a heat transfer mechanism includes a pipe formed in the shape of a helix. In use, the heat transfer mechanism is adapted to transfer heat from the air expelled through the exhaust vent to the air situated within the housing such that the heated air may be directed to the living area.

1 Claim, 1 Drawing Sheet

HEAT TRANSFER UNIT FOR A FURNACE EXHAUST VENT

BACKGROUND OF THE INVENTION

1. Field of the Invention

The present invention relates to heat transfer mechanisms and more particularly pertains to a new heat transfer unit for a furnace exhaust vent for efficiently harnessing heat lost via a heat exhaust vent of a furnace.

2. Description of the Prior Art

The use of heat transfer mechanisms is known in the prior art. More specifically, heat transfer mechanisms heretofore devised and utilized are known to consist basically of familiar, expected and obvious structural configurations, notwithstanding the myriad of designs encompassed by the crowded prior art which have been developed for the fulfillment of countless objectives and requirements.

Known prior art heat transfer mechanisms include U.S. Pat. No. 4,194,558; U.S. Pat. No. 3,934,798; U.S. Pat. No. 4,241,874; U.S. Pat. No. 4,117,883; U.S. Pat. No. 5,311,930; and U.S. Pat. Des. No. 330,076.

In these respects, the heat transfer unit for a furnace exhaust vent according to the present invention substantially departs from the conventional concepts and designs of the prior art, and in so doing provides an apparatus primarily developed for the purpose of efficiently harnessing heat lost via a heat exhaust vent of a furnace.

SUMMARY OF THE INVENTION

In view of the foregoing disadvantages inherent in the known types of heat transfer mechanisms now present in the prior art, the present invention provides a new heat transfer unit for a furnace exhaust vent construction wherein the same can be utilized for efficiently harnessing heat lost via a heat exhaust vent of a furnace.

The general purpose of the present invention, which will be described subsequently in greater detail, is to provide a new heat transfer unit for a furnace exhaust vent apparatus and method which has many of the advantages of the heat transfer mechanisms mentioned heretofore and many novel features that result in a new heat transfer unit for a furnace exhaust vent which is not anticipated, rendered obvious, suggested, or even implied by any of the prior art heat transfer mechanisms, either alone or in any combination thereof.

To attain this, the present invention generally comprises a furnace having a main inlet for receiving cooled air suctioned from a living area. The furnace further includes a heating means for heating the cooled air suctioned from the living area. A main outlet is provided for delivering air to the living area which is heated by the heating means. Lastly, an exhaust vent is coupled to the furnace for expelling air associated with the generation of heat by the heat means. It should be noted that the expelled air is not fit for channeling to the living air via the outlet. Next provided is a housing having a cubical configuration with a bottom face thereof mounted to a top of the furnace. As shown in the Figure, the housing divides the exhaust vent into a lower portion with an open top end and an upper portion with an open bottom. The open top of the lower end extends through the bottom face. On the other hand, the open bottom of the upper portion extends through a top face of the housing. The housing further has an auxiliary inlet in communication with the main inlet for receiving the cooled air from the living area. Associated therewith is an auxiliary outlet in communication with the main outlet for expelling air thereto. Also included is a heat transfer means including a pipe having a circular cross-section that defines an area that is less than half a cross-sectional area of the exhaust vent. The pipe is formed in the shape of a helix defined by a plurality of identical abutting loops. Such loops are situated about a common axis that resides along a diagonal of the housing. In use, the heat transfer means is adapted to transfer heat from the air expelled through the exhaust vent to the air situated within the housing. Finally, a motor driven fan is situated adjacent the inlet of the housing and adapted to direct air through the housing and out the auxiliary outlet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new heat transfer unit for a furnace exhaust vent apparatus and method which has many of the advantages of the heat transfer mechanisms mentioned heretofore and many novel features that result in a new heat transfer unit for a furnace exhaust vent which is not anticipated, rendered obvious, suggested, or even implied by any of the prior art heat transfer mechanisms, either alone or in any combination thereof.

It is another object of the present invention to provide a new heat transfer unit for a furnace exhaust vent which may be easily and efficiently manufactured and marketed.

It is a further object of the present invention to provide a new heat transfer unit for a furnace exhaust vent which is of a durable and reliable construction.

An even further object of the present invention is to provide a new heat transfer unit for a furnace exhaust vent which is susceptible of a low cost of manufacture with regard to both materials and labor, and which accordingly is then susceptible of low prices of sale to the consuming public, thereby making such heat transfer unit for a furnace exhaust vent economically available to the buying public.

Still yet another object of the present invention is to provide a new heat transfer unit for a furnace exhaust vent which provides in the apparatuses and methods of the prior art some of the advantages thereof, while simultaneously overcoming sonic of the disadvantages normally associated therewith.

Still another object of the present invention is to provide a new heat transfer unit for a furnace exhaust vent for efficiently harnessing heat lost via a heat exhaust vent of a furnace.

Even still another object of the present invention is to provide a new heat transfer unit for a furnace exhaust vent that includes a furnace having a main inlet for receiving cooled air suctioned from a living area, a heating mechanism for heating the cooled air suctioned from the living area, a main outlet for delivering air to the living area which is heated by the heating mechanism, and an exhaust vent coupled to the furnace for expelling air associated with the generation of heat by the heat mechanism with such expelled air not being fit for channeling to the living air via the outlet. Next provided is a housing which divides the exhaust vent into a lower portion and an upper portion. The housing has an auxiliary inlet in communication with the living area for receiving the cooled air therefrom and an auxiliary outlet in communication with the living area for expelling air thereto. Lastly, a heat transfer mechanism includes a pipe formed in the shape of a helix. In use, the heat transfer mechanism is adapted to transfer heat from the air expelled through the exhaust vent to the air situated within the housing such that the heated air may be directed to the living area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
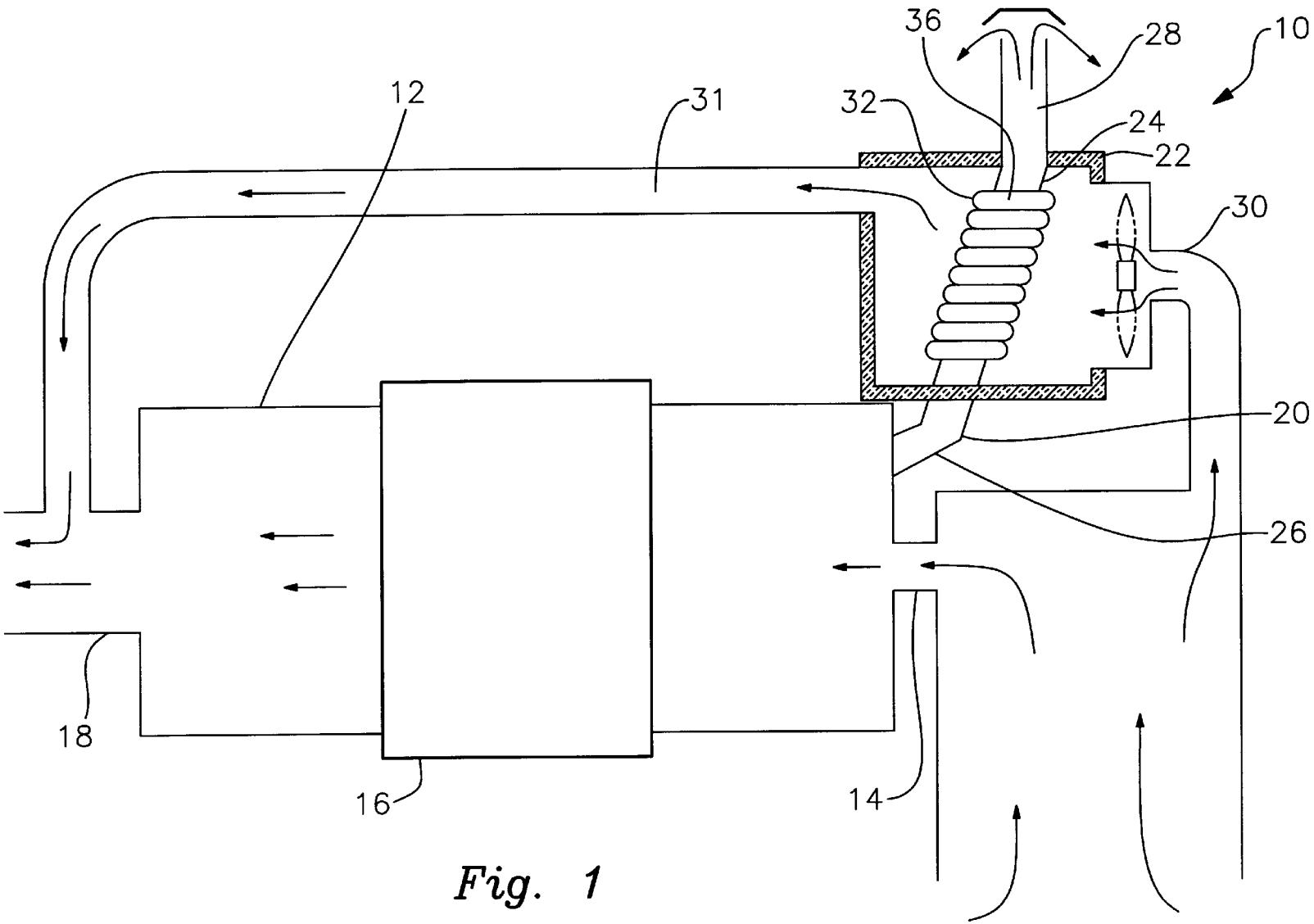
FIG. 1 is a schematic diagram of a new heat transfer unit for a furnace exhaust vent according to the present invention.

With reference now to the drawings, and in particular to FIG. 1 thereof, a new heat transfer unit for a furnace exhaust vent embodying the principles and concepts of the present invention and generally designated by the reference numeral 10 will be described.

The present invention, as designated as numeral 10 includes a furnace 12 having a main inlet 14 for receiving cooled air suctioned from a living area. The furnace further includes a heating means 16 for heating the cooled air suctioned from the living area. A main outlet 18 is provided for delivering air to the living area which is heated by the heating means. Lastly, an exhaust vent 20 is coupled to the furnace for expelling air associated with the generation of heat by the heat means. It should be noted that the expelled air is not fit for channeling to the living air via the outlet. As such, the exhaust fan preferably has an outlet situated exterior of the living area. As shown in FIG. 1, the outlet is equipped with a cover for preventing water from entering the furnace.

Next provided is a housing 22 having a cubical configuration with a bottom face thereof mounted to a top of the furnace. It is imperative that the housing be constructed from an insulative material. As shown in the FIGURE, the housing divides the exhaust vent 24 into a lower portion 26 with an open top end and an upper portion 28 with an open bottom. The open top of the lower end extends through the bottom face. On the other hand, the open bottom of the upper portion extends through a top face of the housing. For reasons that will become apparent hereinafter, the open bottom and open top are offset and reside adjacent opposite side faces.

The housing further has an auxiliary inlet 30 in communication with the main inlet for receiving the cooled air from the living area. The inlet preferably takes the form of an opening which encompasses the entire associated side face. Associated therewith is an auxiliary outlet 31 in communication with the main outlet for expelling air thereto. The auxiliary outlet is preferably mounted to a side face opposite that associated with the auxiliary inlet and is further positioned next to the top face of the housing.

Also included is a heat transfer means 32 including a pipe 34 having a circular cross-section that defines an area that is less than half a cross-sectional area of the exhaust vent. The pipe is formed in the shape of a helix defined by a plurality of identical abutting loops 36. Such loops are situated about a common axis that resides along a diagonal of the housing. The pipe has ends which are coupled in fluidic communication with the open top and open bottom of the exhaust vent. In use, the heat transfer means is adapted to transfer heat from the air expelled through the exhaust vent to the air situated within the housing. By this structure, maximum heat transfer is afforded with the least amount of space occupied by the housing.

Finally, a motor driven fan 40 is situated adjacent the inlet of the housing. The fan functions to direct air through the housing and out the auxiliary outlet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heat exchange system for harnessing heat from an exhaust vent comprising:

a furnace having a main inlet for receiving cooled air drawn from a living area, heating means for heating the cooled air drawn from the living area, a main outlet for delivering to the living area air heated by the heating means, and an exhaust vent coupled to the furnace for expelling exhaust gases associated with the generation of heat by the heat means with such expelled exhaust gases not being suitable for channeling to the living area via the outlet;

a self-contained heat exchange device for positioning adjacent to the furnace, the self-contained heat exchange device comprising:

a housing constructed in a cubical configuration defining an interior of the housing, the exterior of the housing having an insulative material attached thereto, the housing having a bottom face thereof mounted adjacent to a top of the furnace and dividing the exhaust vent into a lower portion with an open top end and an upper portion with an open bottom, the open top of the lower end extending through the bottom face and the open bottom of the upper portion extending through a top face of the housing, the housing further having an auxiliary inlet and an auxiliary outlet forming an air path through the housing in parallel to an air path through the furnace, the auxiliary inlet being in communication with the main inlet for taking a portion of the cooled air drawn from the living area into an interior of the housing, the auxiliary outlet being in communication with the outlet for expelling air from the interior of the housing into the main outlet, the auxiliary inlet extending through a side face of the housing, the auxiliary outlet extending through a side face of the housing opposite the side face through which the auxiliary inlet extends such that air exiting the auxiliary inlet must travel through an entire length of the housing to reach the auxiliary outlet, the auxiliary outlet being located adjacent to the top face of the housing for exhausting the warmest air in the interior of the housing to the main outlet of the furnace;

heat transfer means completely contained in the housing, the heat transfer means including a pipe in tie housing having a circular cross-section which defines an area that is less than half a cross-sectional area of the exhaust vent, the pipe formed in the shape of a helix defined by a plurality of identical abutting loops which are situated about a common axis, wherein the axis of the loops is oriented at an angle to the vertical such that the axis resides along a diagonal of the housing, the heat transfer means being adapted to transfer heat from the air expelled through the exhaust vent to the air situated within the housing, the pipe having opposite upper and lower ends which are in fluidic communication with the respective open bottom and open top of the exhaust vent such that exhaust gases are passed through the loops; and a motor driven fan situated completely in the interior of the housing in a location adjacent to the inlet of the housing and adapted to draw air from the living area through the main inlet of the furnace and direct air through the parallel air path through the housing and out the auxiliary outlet into the main outlet of the furnace for recirculation of the air back into the living area.

* * * * *